US010017880B2

(12) United States Patent
Tung

(10) Patent No.: US 10,017,880 B2
(45) Date of Patent: Jul. 10, 2018

(54) BULKED CONTINUOUS FILAMENTS WITH TRILOBAL CROSS-SECTION AND ROUND CENTRAL VOID AND SPINNERET PLATES PRODUCING FILAMENT

(71) Applicant: INVISTA NORTH AMERICA S.A.R.L., Wilmington, DE (US)

(72) Inventor: Wae-Hai Tung, Marietta, GA (US)

(73) Assignee: INVISTA NORTH AMERICA S.A.R.L., Wilmington, DE (US)

( * ) Notice: Subject to any disclaimer, the term of this patent is extended or adjusted under 35 U.S.C. 154(b) by 192 days.

(21) Appl. No.: 14/735,922

(22) Filed: Jun. 10, 2015

(65) Prior Publication Data

US 2015/0275400 A1 Oct. 1, 2015

Related U.S. Application Data

(62) Division of application No. 13/060,156, filed as application No. PCT/US2009/053878 on Aug. 14, 2009, now abandoned.

(60) Provisional application No. 61/090,931, filed on Aug. 22, 2008.

(51) Int. Cl.

| | |
|---|---|
| ***D01D 4/02*** | (2006.01) |
| ***D01D 5/24*** | (2006.01) |
| ***D01D 5/253*** | (2006.01) |

(52) U.S. Cl.

CPC ..... *D01D 5/253* (2013.01); *D01D 4/02* (2013.01); *D01D 5/24* (2013.01); *Y10T 428/2975* (2015.01)

(58) Field of Classification Search

CPC ..... D01D 4/02; D01D 5/24; D01D 5/253

See application file for complete search history.

(56) References Cited

U.S. PATENT DOCUMENTS

| | | | | | |
|---|---|---|---|---|---|
| 3,357,048 | A | * | 12/1967 | Cobb, Jr. | D01D 5/24 239/601 |
| 3,525,134 | A | | 8/1970 | Coon | |
| 3,772,137 | A | * | 11/1973 | Tolliver | A47C 27/12 425/382.2 |
| 5,168,143 | A | | 12/1992 | Kobsa et al. | |
| 5,322,736 | A | * | 6/1994 | Boyle et al. | D01D 5/24 264/177.14 |
| 5,904,982 | A | | 5/1999 | Kent et al. | |
| 6,048,615 | A | | 4/2000 | Lin | |
| 6,939,608 | B2 | | 9/2005 | Tung | |
| 2005/0266241 | A1 | | 12/2005 | Tung | |

FOREIGN PATENT DOCUMENTS

| | | |
|---|---|---|
| EP | 0625219 | 2/1998 |

* cited by examiner

*Primary Examiner* — Yogendra N Gupta
*Assistant Examiner* — Joseph S Leyson
(74) *Attorney, Agent, or Firm* — Robert B. Furr, Jr.

(57) ABSTRACT

Briefly described, embodiments of the present disclosure include trilobal bulked continuous filaments (BCFs) with a generally round central void, spinneret plates with a capillary design for producing the BCFs of the present disclosure, articles and carpets produced from the BCFs of the present disclosure, methods of producing the trilobal BCFs of the present disclosure, and the like.

9 Claims, 4 Drawing Sheets

BULKED CONTINUOUS FILAMENTS WITH TRILOBAL CROSS-SECTION AND ROUND CENTRAL VOID AND SPINNERET PLATES PRODUCING FILAMENT

CROSS-REFERENCE TO RELATED APPLICATION

This application is a divisional of Non-Provisional application Ser. No. 13/060,156 filed Mar. 25, 2011, a 371 of International Application No. PCT/US09/053878, filed Aug. 14, 2009 and claims benefit of priority from Provisional Application No. 61/090,931 filed Aug. 22, 2008.

BACKGROUND

Bulked continuous filaments (BCFs) of different cross-sections may be formed to impart different qualities to the filaments/fibers and articles produced with the fibers, such as carpet yarn and carpets. The particular cross-sectional geometry of synthetic fibers is known to affect various physical properties of the fiber and articles formed from such fibers. The cross-sectional geometry of BCFs affects both the performance as well as the look and feel of articles, such as carpet, formed from the fibers. For example, the cross-sectional shape of the fiber is known to affect both the soiling durability as well as the "glitter" or "luster" (e.g., the light-reflecting ability) of carpet yarn formed from the fibers.

While carpet yarns having relatively high levels of "glitter" are desired for many applications. Some high glitter filaments, however, require difficult and costly production parameters. For instance, many high glitter fibers have to be spun at relatively high relative viscosity and/or require complicated and less-durable capillary designs, both of which add significant time and expense to the manufacturing process.

Thus, there is a need in the industry for a bulked continuous filament for use as carpet yarn that exhibits high glitter but can be made from materials with relatively low relative viscosities and can thus be spun at normal spin rates. There is also a need in the industry for a spinneret that produces a fiber or filament with the above-mentioned qualities and that is also durable and easy to spin at effective spin rates.

SUMMARY

Embodiments of the present disclosure include trilobal bulked continuous filaments with a generally round central void, spinneret plates with a capillary design for producing the BCFs of the present disclosure, articles and carpets produced from the BCFs of the present disclosure, methods of producing the trilobal BCFs of the present disclosure, and the like.

One exemplary bulked continuous filament, among others, is formed from at least one synthetic polymer and includes: a three-sided exterior configuration, a trilobal cross-sectional geometry including three lobes defined by three rounded tips, and a generally round void extending centrally and axially through the filament. Each side of the filament defines a smoothly curved contour extending between a first and a second rounded tip, each side including a concave region located at the approximate midpoint between each rounded tip. The filament has a major radius R2 extending from a geometric center of the filament to the approximate midpoint of one of the rounded tips and a minor radius R1 extending from the geometric center of the filament to the approximate midpoint of the concave region, and in embodiments, the ratio of the major radius R2 to the minor radius R1 defines an exterior modification ratio (R2/R1) of about 1.35 to about 1.85. Each rounded tip of a filament according to the present disclosure has a tip radius (R3), and in exemplary embodiments the ratio of the major radius (R2) to the tip radius (R3) defines a tip ratio (R2/R3) of about 2.0 to about 10.0, preferably from about 2.0 to about 5.0.

The present disclosure also includes articles, such as textile articles, formed from the trilobal filaments of the present disclosure. The present disclosure also includes yarn and carpet made from the trilobal BCFs of the present disclosure, and the like.

One exemplary spinneret plate, among others, for producing a bulked continuous filament of the present disclosure includes a cluster of three generally U-shaped orifices grouped around a central point, each orifice having an open end and a generally rounded closed end, wherein the closed end points away from the central point. In embodiments of the spinneret plate of the present disclosure, an outer edge of the orifice is defined by first and second outer parallel lines extending from the open end of the "U" towards the closed end and joined at the closed end by a curved portion which defines the generally rounded closed end of the "U", and an inner edge of the orifice forms the open end of the "U" and is defined by first and second inner parallel lines extending from the open end of the "U" substantially parallel to the first and second outer parallel lines and joined by a third inner line being substantially perpendicular to the first and second inner parallel lines.

One exemplary method, among others, for of forming a bulked continuous filament having a trilobal cross section and a single, generally round void extending axially through the filament includes extruding a synthetic polymer through a spinneret plate of the present disclosure to produce the filament.

These embodiments, uses of these embodiments, and other uses, features and advantages of the present disclosure, will become more apparent to those of ordinary skill in the relevant art when the following detailed description of the preferred embodiments is read in conjunction with the appended figures.

BRIEF DESCRIPTION OF THE DRAWINGS

The disclosure can be better understood with reference to the following drawings. The components in the drawings are not necessarily to scale, emphasis instead being placed upon clearly illustrating the principles of the present disclosure.

DETAILED DESCRIPTION

Figure 1:
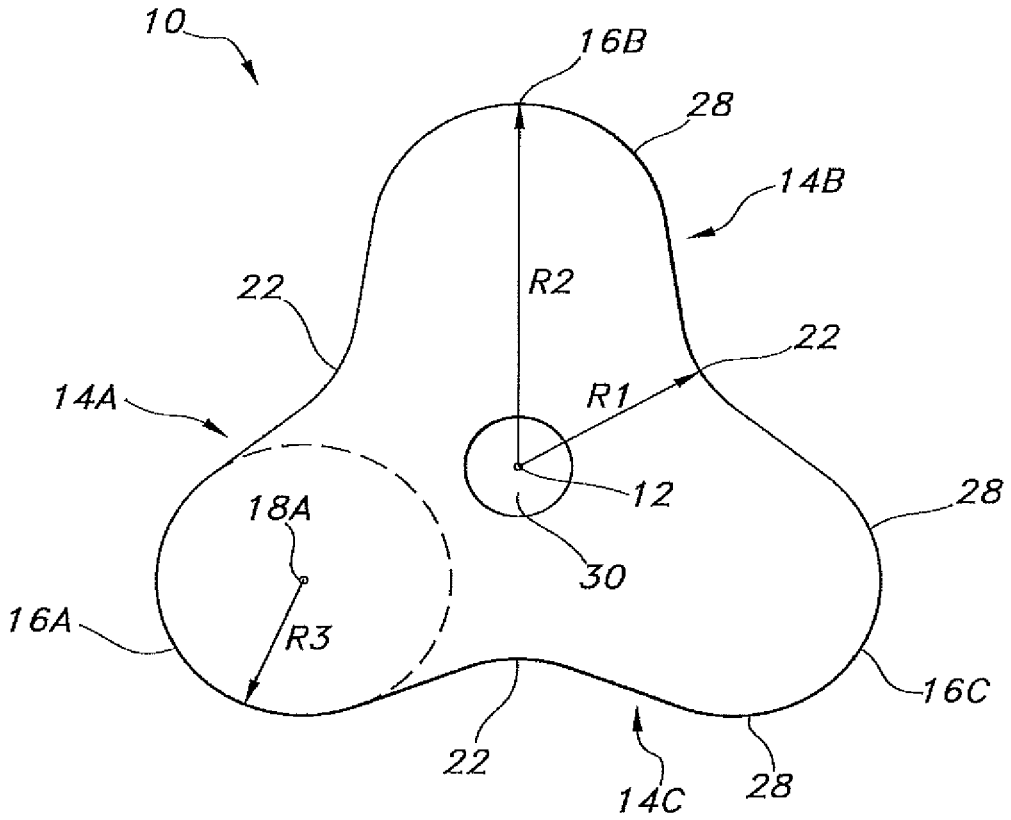
FIG. 1 illustrates a cross-sectional view of a trilobal filament of the present disclosure.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, fiber, fabrics, textiles, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is in atmosphere. Standard temperature and pressure are defined as 25° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Definitions

As used herein, the terms "fiber" and "filament" refer to filamentous material that can be used in fabric and yarn as well as textile fabrication. Although in the art the term "filament" is often used to refer to fibers of extreme or indefinite length and the term "staple" is used to refer to a fiber of relatively short length, unless indicated otherwise in the surrounding text, the terms "fiber" and "filament" are used interchangeably in the present disclosure. One or more fibers can be used to produce a fabric or yarn. The yarn can be fully drawn or textured according to methods known in the art.

As used herein the term "yarn" refers to a continuous strand or bundle of fibers. Yarn is often used to make articles, such as carpets.

As used herein "glitter" is the property of the yarn relating to the yarn's ability to reflect incident light. The amount of glitter exhibited by a yarn is a measure of the relative fraction of light that is reflected by the yarn. Glitter is also sometimes referred to as "luster".

"Bulk" is the property of the yarn that most closely correlates to surface coverage ability of a given yarn.

As used herein, the terms "article" or "articles" includes, but are not limited to, fibers, yarns, films, carpets, apparel, furniture coverings, drapes, automotive seat covers, fishing nets, awnings, sail cloth, polyester tie-cord, hoist PET, military apparel, conveying belts, mining belts, water draining cloth, tarps (e.g., truck tarps), seat belts, harnesses, and the like. In particular, the article can be claimed as any one or combination of the articles noted above. In exemplary embodiments of the present disclosure, the article is carpet.

As used herein, the term "carpet" may refer to a structure including a primary backing having a yarn tufted through the primary backing. The underside of the primary backing can include one or more layers of material (e.g., coating layer, a secondary backing, and the like) to cover the backstitches of the yarn. In addition, the term "carpet" can include woven carpets without backing. In exemplary embodiments, the yarn used to form the carpet is made of bulked continuous filaments (BCFs), such as those of the present disclosure. Methods for making BCF yarns for carpets typically include the steps of twisting, heat-setting, tufting, dyeing and finishing.

As used herein the term "relative viscosity" (RV) refers to the viscosity property of a fiber-forming polymer which is the ratio of the viscosity of the polymer solution to the solvent viscosity.

The term "modification ratio" refers herein to the ratio of the major radius R2 (as defined below) to the minor radius R1 (defined below).

"Tip radius," as used herein, refers to the ratio of the major radius (defined below) to the tip radius (defined below).

General Discussion

Embodiments of the present disclosure are directed to thermoplastic synthetic polymer bulked continuous filaments (BCFs) having a trilobal cross section and a generally round/circular axial void extending through the filament. The trilobal filament of the present disclosure exhibits high-glitter, provides good soil resistance, and can be spun from polymer materials with a relatively low relative viscosity. Carpet fibers made with this cross section have a glittery bright luster. In embodiments, the cross section of the filament of the present disclosure has modification ratio that can be about 1.35 to 1.85 and tip radius ratio that can be about 2.0 to 10.0, preferably in the range of about 2.0 to 5.0.

The present disclosure also includes yarn formed from a plurality of such filaments which is easily bulked and, due to high glitter is believed to be especially useful as carpet yarn where a high-luster look is desired, particularly as an accent yarn for commercial carpets. The present disclosure is also directed to articles, including, but not limited to, carpets, made from such yarns. Furthermore, the present disclosure also includes a spinneret plate having a capillary design for producing the filament of the present disclosure.

Carpets made from polymer yarns, and particularly polyamide yarns such as nylon, are popular floor coverings for residential and commercial applications. Such carpets are relatively inexpensive and have a desirable combination of qualities, such as durability, aesthetics, comfort, safety, warmth, and quietness. Further, such carpets are available in a wide variety of colors, patterns, and textures. In particular, carpets have various levels of "glitter," and the amount of glitter desired depends on the use of the carpet. Often, a high-glitter look is preferred for accent yarns for commercial carpets. Additionally, carpets made from polymer yarns have other properties, such as soil/stain resistance, bulk, and durability.

The previously known, so-called "metallic-effect yarn" has been used as an accent yarn for commercial carpets. It has a bright and glittery luster that sets it apart from other yarns. Due to the specific capillary design required for production of the metallic-effect yarn, metallic-effect yarn has to be produced with a fairly high RV polymer (e.g., 78 or higher) to produce the desired cross section shape to achieve a glittery look. Such cross-sections are generally hollow and trilobal. The high RV polymers needed for production of the metallic-effect yarn require extensive solid phase polymerization that shortens the spinning machine maintenance cycle. This is especially true in making pigmented or solution dyed nylon yarns. The majority of pigments used for making color yarns contain low viscosity polymeric carriers. They drastically reduce nylon polymer RV during the melt spinning process. Thus it is extremely difficult to make glittery yarns such as DSDN or Lumena® using the metallic-effect cross section.

The present disclosure provides a novel filament having a novel hollow trilobal cross section with a near round void in the middle. Embodiments of the present disclosure also include yarns, articles (e.g., carpet) made from the filament of the present disclosure, as well as methods of making the filament, and spinneret plates with the novel capillary design for producing the filament of the present disclosure. BCF of the present disclosure can be easily made with polymers of lower RVs that are comparable to the RVs used for spinning standard (non-glittery) fibers. For instance, the filaments of the present disclosure can be made at "normal" spinning RV of about 60 to 70. Furthermore, carpets made from yarn produced with filaments of the present disclosure have a brighter and higher glitter look than carpets made from metallic-effect fibers. It has been very difficult to make solution dyed yarn with glittery luster using the metallic-effect cross section due to high RV requirement, but the filaments of the present disclosure can easily be made into solution dyed yarn with a glittery look due to the lower RV requirement than producing the metallic-effect fibers.

As illustrated in FIG. 1, a bulked continuous filament 10 of the present disclosure has a trilobal cross-sectional geometry with three lobes defined by three rounded tips 16 (16A, 16B, and 16C). A longitudinal axis 12 extending through the filament 10 serves as its geometric center. Each filament 10 has a generally three-sided exterior configuration formed from sides 14A, 14B, and 14C. The side 14A is defined by a smoothly curved contour extending between a first rounded tip 16A and a second rounded tip 16B. The side 14B is defined by a smoothly curved contour extending between the second rounded tip 16B and a third rounded tip 16C. The side 14C is defined by a smoothly curved contour extending between the third rounded tip 16B and the rounded first tip 16A.

The filament 10 has an exterior configuration characterized by alternating convex and concave regions. The portion of each exterior side 14 that forms a part of each rounded tip 16 has a convex contour. Each exterior side 14 also has a concave region located at the approximate midpoint between each rounded tip. Thus, each exterior side 14A, 14B, and 14C has a concave, or inwardly extending depressed, region 22 disposed approximately midway between the two adjacent rounded tips 16. By "concave" or "depressed region" it is meant that the contour of the filament in that region extends inwardly toward the axis 12 of the filament. Each exterior side 14A, 14B, and 14C of the filament 10 thus exhibits a smoothly curving configuration having two convex regions (e.g., the rounded regions 26 disposed near each rounded tip of each side) and one concave region (e.g., the depressed region 22).

The distance from the geometric center (or axis) 12 to the point(s) on the exterior contour of the filament 10 closest to the geometric center (e.g., the approximate midpoint of the concave region 22) defines the minor radius (R1) of the filament. A major radius (R2) is defined as the distance from the geometric center 12 to the point(s) on the exterior contour of the filament that lie farthest from the geometric center 12 (e.g., the approximate midpoint of each rounded tip). Additionally, the distance from a respective center of generation 18A, 18B, and 18C to each rounded tip 16A, 16B, and 16C is indicated by a tip radius R3 (only one of which is illustrated in FIG. 1 for clarity of illustration).

In embodiments R1 can be about 0.001 to 0.010 centimeter, R2 can be about 0.005 to 0.050 centimeter, and R3 can be about 0.0005 to 0.0050 centimeter. The ratio of the major radius (R2) to the minor radius (R1) defines an exterior modification ratio (R2/R1). In general a filament 10 in accordance with the present disclosure has an exterior modification ratio (R2/R1) that can be about 1.35 to 1.85, and more particularly can be about 1.50 to 1.75. In addition, the ratio of the major radius (R2) to the tip radius (R3)

defines a tip ratio (R2/R3) that can be about 2 to 10, and more particularly can be about 2.0 to 5.0.

The filament 10 has a void 30 extending centrally and axially therethrough. The axis 12 defines the geometric center of the void. The void ratio of a BCE can be important in determining various properties of the filament and articles made from the filament. The void ratio of the filament of the present disclosure preferably can be about 1 to 25% of cross-sectional area of the filament. In an exemplary embodiment the void ratio of the filament can be about 2% of the cross-sectional area of the filament.

A filament in accordance with the present disclosure is a bulked continuous filament prepared using a synthetic, thermoplastic melt-spinnable polymer. Suitable polymers include polyamides, polyesters, and olefins. In an exemplary method of forming filaments according to the present disclosure, the polymer is first melted and then is extruded ("spun") through a spinneret plate having appropriately sized orifices therein (to be described hereinafter), under conditions that vary depending upon the individual polymer, to produce a filament 10 having the desired denier, exterior modification ratio, tip ratio, and void percentage. In embodiments, the filaments can be subsequently quenched by air flowing across them at a flow rate of about 1.2-1.8 ft/sec (about 0.36 to 0.55 m/sec). Void percentage can be increased by more rapid quenching and increasing the melt viscosity of thermoplastic melt polymers, which can slow the flow allowing sturdy pronounced molding to occur.

After being spun the fibers of the present disclosure may then be treated with a finish comprising a lubricating oil or mixture of oils and antistatic agents. A plurality of filaments 10 can be gathered together to form a yarn, and the yarn bundle can then be wound on a suitable package. Drawing and bulking of the combined filaments is performed by any method known in the art, with the preferred operating condition described below in the examples provided. The yarn is then used to make articles, such as carpet, by methods known to those of skill in the art. An exemplary method of making carpet from yarn formed from filaments of the present disclosure is described in the examples below.

In exemplary embodiments, the yarn is drawn and texturized to form a BCF yarn suitable for tufting into carpets. One technique involves combining the extruded or as-spun fibers into a yarn, then drawing, texturizing and winding into a package all in a single step. This one-step method of making BCF yarn is generally known in the art as spin-draw-texturing (SDT).

In some embodiments, nylon fibers for the purpose of carpet manufacturing have linear densities of about 3 to 75 denier/filament (dpf (denier=weight in grams of a single fiber with a length of about 9000 meters). A more preferred range for carpet fibers can be about 6 to 25 dpf.

The BCF yarns can go through various processing steps well known to those skilled in the art. For example, to produce carpets for floor covering applications, the BCF yarns are generally tufted into a pliable primary backing. Primary backing materials are generally selected from woven jute, woven polypropylene, cellulosic nonwovens, and nonwovens of nylon, polyester and polypropylene. The primary backing can then be coated with a suitable latex material such as a conventional styrene-butadiene (SB) latex, vinylidene chloride polymer, or vinyl chloride-vinylidene chloride copolymers. It is common practice to use fillers such as calcium carbonate to reduce latex costs. The final step is typically to apply a secondary backing, generally a woven jute or woven synthetic such as polypropylene. In embodiments, carpets for floor covering applications may include a woven polypropylene primary backing, a conventional SB latex formulation, and either a woven jute or woven polypropylene secondary carpet backing. The SB latex can include calcium carbonate filler and/or one or more of the hydrate materials listed above.

While the discussion above has emphasized the fibers of this disclosure being formed into bulked continuous fibers for purposes of making carpet fibers, the fibers of this disclosure can be processed to form fibers for a variety of textile applications. In this regard, the fibers can be crimped or otherwise texturized and then chopped to form random lengths of staple fibers having individual fiber lengths varying from about 1½ to 8 inches.

The fibers of the present disclosure can be dyed or colored utilizing conventional fiber-coloring techniques known to those of skill in the art. For example, the fibers of this disclosure may be subjected to an acid dye bath to achieve desired fiber coloration. Alternatively, the polymer may be colored in the melt prior to fiber-formation (e.g., solution dyed) using conventional pigments for such purpose.

As discussed above, fibers of various cross-sections are formed by melt-spinning fiber-forming polymers through specially designed spinnerets. Spinneret plates used to make fibers have specially designed orifices through which the polymers are melt-spun to produce the fibers. Often, the orifices, or a specific cluster of orifices, used to produce a single fiber is called a capillary. Thus, spinnerets with specifically designed capillaries are used to produce corresponding fibers of a desired cross-sectional geometry. As discussed above, the capillary design for the metallic-effect fibers described in U.S. Pat. No. 6,048,615 require the use of a high RV polymer that makes the spinning process inefficient and results in more wear and tear on the capillary and/or spinneret. However, the geometry of the filament of the present disclosure can be produced by a spinneret with a novel capillary design that is easier to spin and can be used with a lower RV polymer, which can be spun at higher speeds with less wear on the spinneret.

Figure 2A:
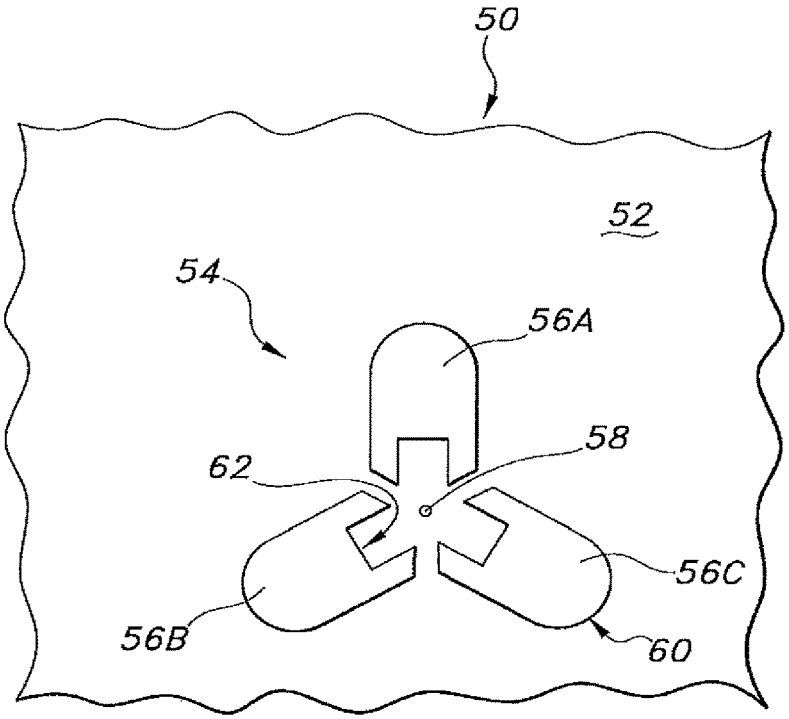
FIG. 2A illustrates a face view of the bottom surface of a portion of a spinneret plate illustrating the capillary design for forming the filament of the present disclosure.

FIG. 2A illustrates a spinneret plate 50 useful for producing a filament 10 in accordance with the present disclosure. The spinneret plate 50 can be a relatively massive member having an upper surface (not shown) and a bottom surface 52. As is well appreciated by those skilled in the art a portion of the upper surface of the spinneret plate is provided with a bore recess (not shown) whereby the plate 50 is connected to a source of polymer. Depending upon the rheology of the polymer being extruded the lower margins of the bore recess may be inclined to facilitate flow of polymer from the supply to the spinneret plate.

A plurality of capillary openings each generally indicated by the reference character 54 extends through the plate 50 from the recessed upper surface to the bottom surface 52. Each capillary opening 54 serves to form one filament. Only one such capillary opening 54 is illustrated in FIG. 2A. The number of capillary openings provided in a given plate thus corresponds to the number of filaments being gathered to form a predetermined number of yarn(s). As noted, additional filaments (if used) may be incorporated into the yarn in any convenient manner.

As best seen in FIG. 2A, in the present disclosure each capillary opening 54 is itself defined by a cluster of three orifices 56A, 56B, and 56C centered symmetrically about a central point 58. The spinneret plate may be fabricated in any appropriate manner, as by using the laser technique disclosed in U.S. Pat. No. 5,168,143, (Kobsa et al., QP-4171-A), assigned to the assignee of the present disclosure.

The spinneret plate 50 of the present disclosure is designed to produce the filament of the present disclosure with a trilobal cross-section and a generally round central void. The capillary design of the spinneret plate 50 includes a cluster of three orifices 56 (56A, 56B, and 56C) grouped around a central point 58, where each orifice 56 is generally U-shaped with the rounded, closed end of the U 60 pointing away from the central point 58. The orifice also has a generally squared-off open end 62 that points toward the central point.

Figure 2B:
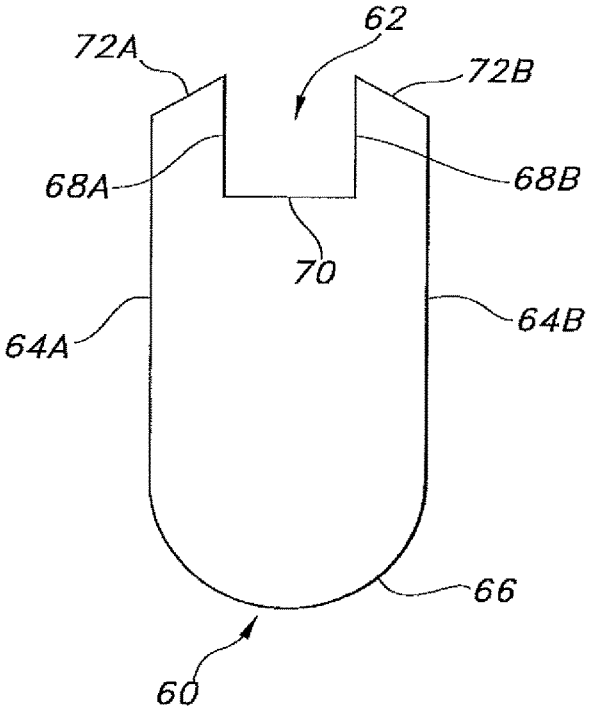
FIG. 2B illustrates a close-up view of one of three orifices of the capillary of FIG. 2A.

A close-up illustration of one of the three orifices 56 is shown in FIG. 2B. The generally U-shaped configuration of the orifice is defined by an outer edge that forms the outer edge and closed end of the "U" 60 and an inner edge that forms the open end of the "U" 62. The outer edge is formed by first and second outer parallel lines (64A and 64B) extending from the open end of the "U" 62 towards the closed end 60 and joined at the closed end 60 by a curved portion 66, which defines the generally rounded closed end of the "U". The inner edge forms the open end of the "U" 62 and is defined by first and second inner parallel lines (68A and 68B) extending from the open end of the "U" 62 and running substantially parallel to the first and second outer parallel lines (64A and 64B). First and second inner parallel lines (68A and 68B) are joined by a third inner line 70 that is substantially perpendicular to the first and second inner parallel lines. The three inner lines form the generally squared-off open end of the "U." The first outer parallel line and first inner parallel line are joined by a top line 72A, and the second outer parallel line and second inner parallel line are joined by a top line 72B. In embodiments, lines 72A and 72B are not perpendicular to either of the first and second outer parallel lines or the first and second inner parallel lines. In embodiments, the angle formed between outer parallel line 64A or 64B and line 72A or 72B can be greater than about 90 degrees. In embodiments, the angle formed between inner parallel line 68A or 68B and line 72A or 72B can be less than about 90 degrees.

In embodiments the distance from central point 58 to the outer-most point of the curved portion 66 of the rounded, closed end 60 can be about 0.020 to 0.200 centimeters, and in an exemplary embodiment it is about 0.0711 centimeters. In some embodiments of the spinneret plate of the present disclosure the distance between first outer parallel line 64A and second outer parallel line 64B can be about 0.0100 to 0.1000 centimeters, and in an exemplary embodiment can be about 0.0356 centimeters. In some embodiments of the present disclosure the distance between first inner parallel line 68A and second inner parallel line 68B can be about 0.0050 to 0.0500 centimeters, and in an exemplary embodiment is about 0.0.0178 centimeters. In embodiments of the present disclosure, the distance from central point 58 to the approximate midpoint of third inner line 70 can be about 0.0080 to 0.800 centimeters, and in an exemplary embodiment it is about 0.0280 centimeters. Additionally, in some embodiments the distance between line 72A of one orifice and line 72B of an adjacent orifice can be about 0.0030 to 0.0300 centimeters, and in an exemplary embodiment is about 0.0102 centimeters.

The various above-defined features of the capillary that open onto the bottom surface 52 of the spinneret plate 50 are defined by parallel surfaces that extend from the bottom surface 52 for at least a portion of the way through the thickness of the plate. This distance is usually termed in the art as the "cap depth". The parallel surfaces are spaced from each other by a dimension known in the art as the "slot width". In the production of a polyamide filament the surfaces defining the apertures of the capillary extend in parallel relationship completely through the thickness of the plate 50. For filaments made of other materials, such as polypropylene, it sometimes preferred (for considerations relating to the spinning process) that the parallel surfaces extend over only a predetermined portion of the thickness of the plate, this portion forming a recess in the spinneret plate. Over the remaining portion of this thickness of the plate the surfaces defining the apertures incline outwardly from the axis of the aperture at an angle of inclination on the order of about 45 degrees, though this angle may vary from about 0 to about 60 degrees. The overall dimension of the slot (perpendicular to the bottom surface 20B) is usually referred to in the art as the "slot depth". The slot depth is understood to include both the parallel portion of the slot and the tapered portion of the slot. In embodiments of the spinneret plate of the present disclosure the slot depth of the capillary can be from about 0.010 to 0.300 centimeters.

The capillary design of the spinneret plate of the present disclosure is very durable and easy to spin. This reduces costly repairs and loss of time due to capillary malfunction. The present disclosure also provides methods of making the trilobal filament of the present disclosure by spinning the fibers using the spinneret plate of the present disclosure having the above-described capillary design.

Additional detailed description of some exemplary embodiments of the BCF of the present disclosure and articles made with the filament of the present disclosure are described in the Examples below. However, the specific examples below are to be construed as merely illustrative, and not limitative of the remainder of the disclosure in any way whatsoever. Without further elaboration, it is believed that one skilled in the art can, based on the description herein, utilize the present disclosure to its fullest extent.

EXAMPLES

Example 1: Sample Preparation

Figure 3:
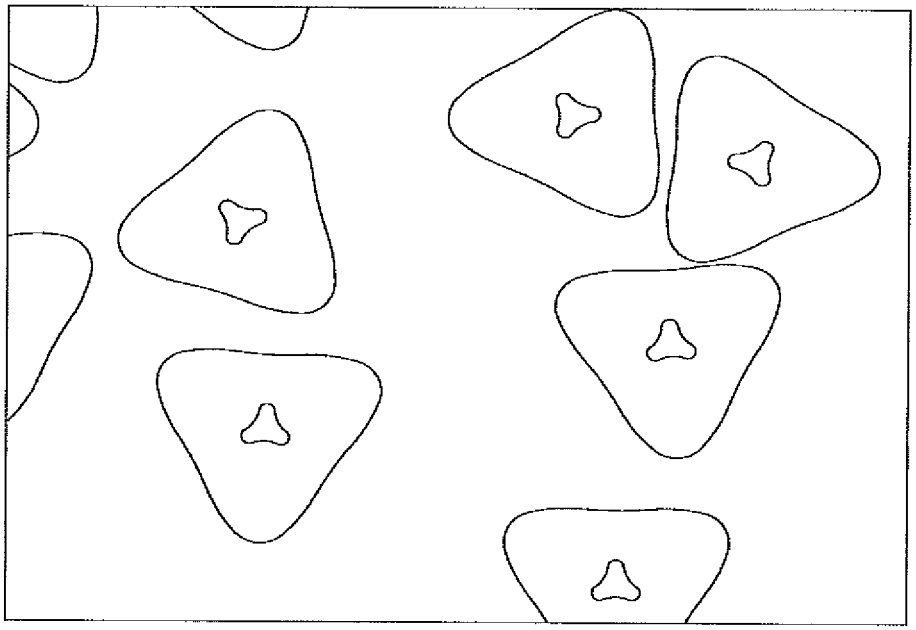
FIG. 3 (Prior Art)
FIG. 3 is a digital image of a cross-section view of a plurality of prior art "metallic effect" filaments (U.S. Pat. No. 6,048,615).
Figure 4:
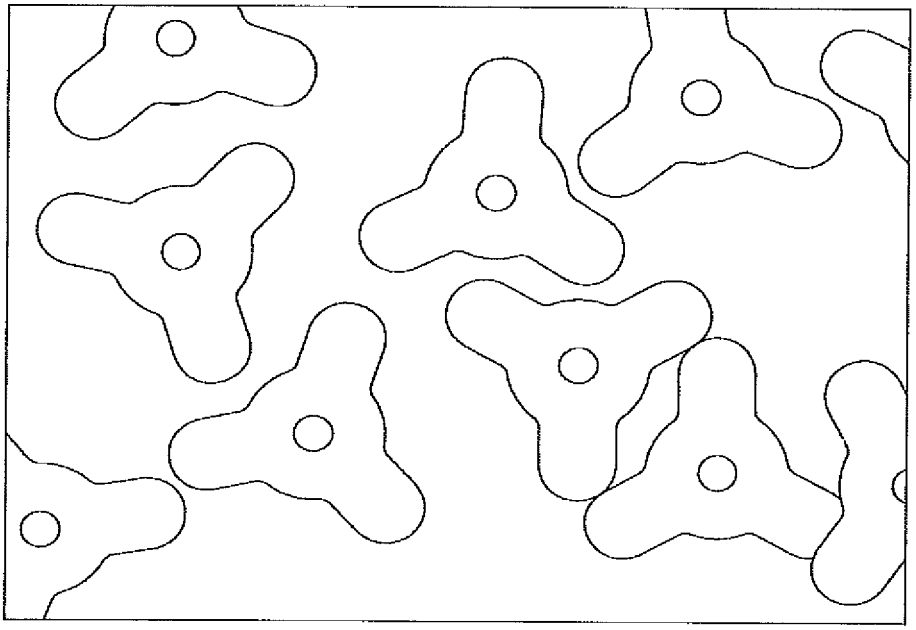
FIG. 4 (Prior Art)
FIG. 4 is a digital image of a cross-sectional view of several prior art single void trilobal cross section filaments known as Brilliance® (U.S. Pat. No. 6,939,608).
Figure 5:
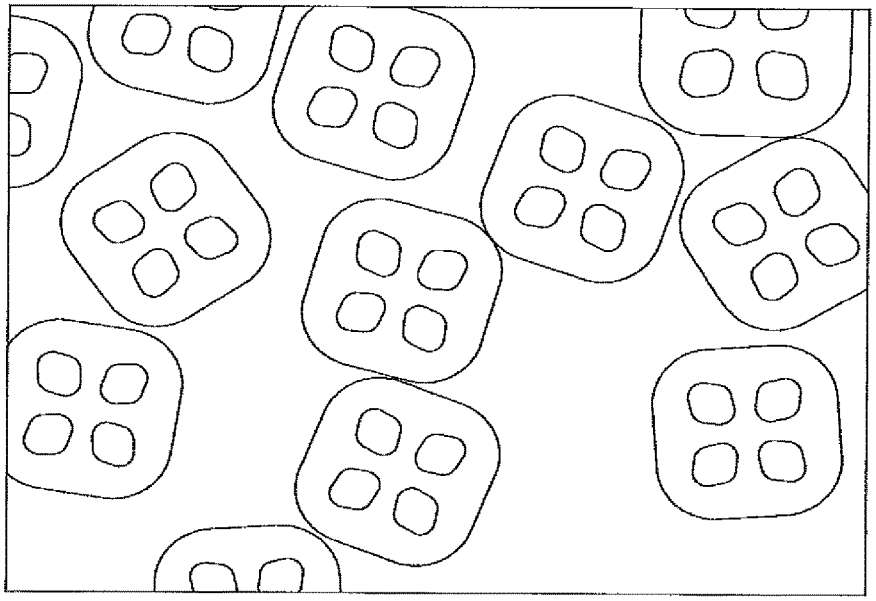
FIG. 5 is a digital image of a cross-sectional view of several prior art 4-void square hollow filaments (Antron® by Invista).
Figure 6:
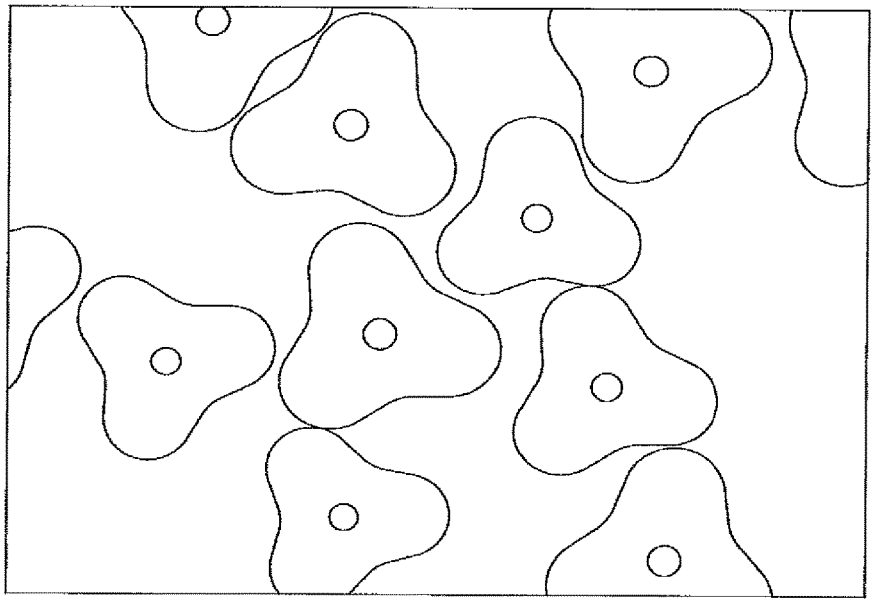
FIG. 6 is a digital image of a cross-sectional view of several trilobal filaments of the present disclosure.

Nylon 6,6 BCF having various cross-sections were produced for the carpet tests described below. FIGS. 3, 4, and 5 are digital images of cross sectional pictures of comparative samples. FIG. 6 is a digital image of a cross sectional picture of the trilobal filament of the present disclosure. FIG. 2, described in detail above, illustrates the capillary design used to make the filament of FIG. 6. The spinnerets used to produce these examples had two groups of 64 capillaries.

The nylon 6,6 polymer used for all of the examples was a bright polymer. The polymer spin dope did not contain any delustrant. The polymer temperature before the spinning pack was controlled at about two hundred ninety plus/minus one degree Centigrade (286+/−1° C.). The spinning throughput was seventy pounds (76 lbs; 31.8 kg) per hour.

The relative viscosity (RV) was measured by dissolving 5.5 grams of nylon 6,6 polymer in fifty cubic centimeters (50 cc) of formic acid. The RV is the ratio of the absolute viscosity of the nylon 66/formic acid solution to the absolute viscosity of the formic acid. Both absolute viscosities were measured at twenty-five degrees Centigrade (25° C.).

The polymer was extruded through the spinnerets and divided into two (2) sixty-four filament (64) segments. The molten fibers were then rapidly quenched in a chimney, where cooling air at about nine degrees Centigrade (−10° C.) was blown past the filaments at three hundred and fifty cubic feet per minute [350 cfm] through the quench zone. The filaments were then coated with a lubricant for drawing and crimping. The coated yarns were drawn at 2380 yards per minute (2.6×draw ratio) using a pair of heated draw rolls. The draw roll temperature was one hundred sixty degrees Centigrade (160° C.). The filaments were then forwarded into a dual-impingement hot air bulking jet, similar to that described in Coon, U.S. Pat. No. 3,525,134, to form two 1245 denier, 19.4 denier per filament (dpf) bulked continuous filament (BCF) yarns. The temperature of the air in the bulking jet was 185 degrees Centigrade (° C.).

The spun, drawn, and crimped bulked continuous filament (BCF) yarns were cable-twisted to 3.75 turns per inch (tpi) on a cable twister and heat-set on a Superba heat-setting machine at setting temperature of two hundred sixty five degrees Fahrenheit (265° F.; 129.4° C.).

The yarns were then tufted into 36 ounce per square yard, 5/16 inch pile height loop pile carpets on a 1/10 inch gauge (0.254 cm) loop pile tufting machine. The tufted carpets were dyed on a continuous range dyer into light beige color carpets.

Example 2 (Comparative)

A carpet sample (UN-10) was prepared as described in Example 1 above using prior art filaments shown in FIG. 3. The filaments had a metallic-effect cross section and were produced, as described in Example 1, using a 78 RV Nylon 66 polymer.

Example 3 (Comparative)

A carpet sample (UN-1) was prepared as described in Example 1 above using prior art filaments shown in FIG. 4. The filaments had a Brilliance® (U.S. Pat. No. 6,939,608) cross section and were produced, as described in Example 1, using a 78 RV Nylon 66 polymer Example 4 (Comparative)

A carpet sample (UN-13) was prepared as described in Example 1 above using prior art filaments shown in FIG. 5. The filaments had a 4-hole square cross section and were produced, as described in Example 1, using a 78 RV Nylon 66 polymer Example 5 (Trilobal Filament of Present Disclosure)

A carpet sample (UN-6) was prepared as described in Example 1 above using the trilobal filaments of the present disclosure shown in FIG. 6. The filaments were made, as described in Example 1, using a 64 RV Nylon 66 polymer and the spinneret of the present disclosure.

Results:

The finished carpets were examined by a panel of carpet researchers for luster assessment. The results are summarized below.

Example 5>Example 2>Example 4>Example 3

The carpet samples made with the BCF of the present disclosure (example 5) were judged to have a significantly brighter luster than all comparative samples.

Thus, this demonstrates that the BCF fibers of the present disclosure and the spinneret design used for making the BCF fibers of the present disclosure provide significant advantages over known BCF fibers and their corresponding spinnerets.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'.

Many variations and modifications may be made to the above-described embodiments. All such modifications and variations are intended to be included herein within the scope of this disclosure and protected by the following claims.

I claim:

1. A spinneret plate for producing a bulked continuous filament comprising:

a cluster of three generally U-shaped orifices grouped around central point, each orifice having an open end and a generally rounded closed end, wherein the closed end points away from the central point, each orifice having an outer edge and an inner edge, the outer edge defined by first and second outer parallel lines extending from the open end of the "U" towards the closed end and joined at the closed end by a curved portion which defines the generally rounded closed end of the "U", and the inner edge forming the open end of the "U" and defined by first and second inner parallel lines extending from the open end of the "U" substantially parallel to the first and second outer parallel lines and joined by a third inner line being substantially perpendicular to the first and second inner parallel lines.

2. The spinneret plate of claim 1, wherein the first outer parallel line and first inner parallel line are joined by a first top line, and the second outer parallel line and second inner parallel line are joined by a second top line.

3. The spinneret plate of claim 2, wherein the first and second top lines are not perpendicular to either of the first and second outer parallel lines or the first and second inner parallel lines.

4. The spinneret plate of claim 2, wherein an angle formed between one of the first and second outer parallel lines and the respective top line adjacent thereto is greater than about 90 degrees.

5. The spinneret plate of claim 2, wherein an angle formed between one of the first and second inner parallel lines and the respective top line adjacent thereto is less than about 90 degrees.

6. The spinneret plate of claim 1, wherein the distance between the first outer parallel line and the second outer parallel line is about 0.0100 to 0.1000 centimeters.

7. The spinneret plate of claim 1, wherein the distance between the first inner parallel line and the second inner parallel line is about 0.0050 to 0.0500 centimeters.

8. The spinneret plate of claim 1, wherein the distance from the central point to the third inner line is about 0.0080 to 0.800 centimeter.

9. The spinneret plate of claim 2, wherein the distance between the first top line of one orifice and the second top line of an adjacent orifice is about 0.0030 to 0.0300 centimeter.

* * * * *